US009803873B2

(12) United States Patent
Rowley et al.

(10) Patent No.: US 9,803,873 B2
(45) Date of Patent: Oct. 31, 2017

(54) OVEN RANGE APPLIANCE

(71) Applicant: General Electric Company, Schenectady, NY (US)

(72) Inventors: Samuel Warren Rowley, Louisville, KY (US); Gonzalo Luis Ocano, Louisville, KY (US); Robert Paul Bollman, Louisville, KY (US); Joshua Adam Mayne, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 261 days.

(21) Appl. No.: 14/859,415

(22) Filed: Sep. 21, 2015

(65) Prior Publication Data

US 2017/0082299 A1 Mar. 23, 2017

(51) Int. Cl.

| | |
|---|---|
| ***F24C 15/30*** | (2006.01) |
| ***F24C 15/00*** | (2006.01) |
| *F24C 15/32* | (2006.01) |

(52) U.S. Cl.
CPC ..... *F24C 15/006* (2013.01); *F24C 15/30* (2013.01); *F24C 15/322* (2013.01)

(58) Field of Classification Search
CPC ..... F24C 15/006; F24C 15/30; F24C 15/322
USPC ..... 126/21 R, 21 A, 15 A, 15 R, 273; 219/757
See application file for complete search history.

(56) References Cited

U.S. PATENT DOCUMENTS

| | | | | |
|---|---|---|---|---|
| 3,682,156 | A * | 8/1972 | Perl | F24C 15/2007 126/21 A |
| 4,763,638 | A * | 8/1988 | Hurley | F24C 14/025 126/21 A |
| 4,865,010 | A * | 9/1989 | Kett | F24C 15/2007 126/21 R |
| 5,509,403 | A | 4/1996 | Kahlke et al. | |
| 6,761,159 | B1 * | 7/2004 | Barnes | F24C 15/2007 126/15 R |
| 7,762,250 | B2 * | 7/2010 | Elkasevic | F24C 15/006 126/190 |
| 7,954,485 | B2 | 6/2011 | Cadima et al. | |
| 8,242,414 | B2 | 8/2012 | Hasslberger et al. | |
| 2014/0150771 | A1 | 6/2014 | Gayle et al. | |
| 2014/0158110 | A1 | 6/2014 | Braden et al. | |
| 2014/0305424 | A1 | 10/2014 | Braden et al. | |
| 2016/0215988 | A1 * | 7/2016 | Braden | F24C 15/2042 |

* cited by examiner

*Primary Examiner* — Gregory Huson
*Assistant Examiner* — Nikhil Mashruwala
(74) *Attorney, Agent, or Firm* — Dority & Manning, P.A.

(57) ABSTRACT

An oven range appliance including a chamber liner defining a cooking chamber, as well as a cabinet enclosing the chamber liner in cooking chamber, is provided. The cabinet includes a side panel positioned at a first side of the cabinet defining a cooling channel between the chamber liner and the side panel of the cabinet. A diverter panel is provided extending from the side panel towards the chamber liner. The diverter panel blocks a flow of cooling air from the cooling channel at a location proximate a back side of the cabinet to increase a flow of cooling air from the cooling channel at a location proximate the front side of the cabinet.

17 Claims, 5 Drawing Sheets

OVEN RANGE APPLIANCE

FIELD OF THE INVENTION

The present subject matter relates generally to oven range appliances, such as oven range appliances including an airflow diverter.

BACKGROUND OF THE INVENTION

Oven range appliances generally include a cabinet that defines a cooking chamber for baking or broiling food items therein, as well as a cooktop positioned at a top portion of the cabinet for, e.g., grilling, boiling or frying food items thereon. To heat the cooking chamber, oven range appliances include heating elements, such as a bake heating element positioned at a bottom portion of the cooking chamber and/or a broil heating element positioned at a top portion of the cooking chamber. During operation of such heating elements, the cabinet and other components of the oven range appliance can be heated. In particular, an outer surface of the cabinet can be heated during operation of such heating elements.

The outer surface of the cabinet is preferably maintained below a threshold temperature during operation of the oven range appliance. Certain oven range appliances include a duct system that draws or pulls air into the cabinet for cooling the outer surface of the cabinet during operation of such oven range appliances. Specifically, certain oven range appliances define a cooling channel between, e.g., the cooking chamber and a side panel of the cabinet. Air may flow into the cooling chamber proximate a bottom end of the oven range appliance, and flow vertically upward through the cooling channel to maintain a surface of, e.g., the side panel of the cabinet below a desired temperature threshold.

However, in at least some of these oven range appliances, an airflow through the cooling channel tends to flow directly towards a rear end of the oven range appliance as such airflow rises to a top end of the oven range appliance. With such a configuration, nonuniform cooling may occur on a surface of the side panel. Therefore, a device providing for more uniform cooling of the surface of the side panel would be useful. More particularly, device for providing more uniform cooling of the surface of the side panel by more evenly distributing a cooling airflow through the cooling channel would be particularly beneficial.

BRIEF DESCRIPTION OF THE INVENTION

The present subject matter provides an oven range appliance. The oven range appliance includes a cabinet. The cabinet defines a width. A cooktop is positioned at a top portion of the cabinet. The cooktop includes a ceramic panel. The ceramic panel defines a width. The width of the ceramic panel is about equal to the width of the cabinet. Thus, the ceramic panel can extend across the width of the cabinet. Additional aspects and advantages of the invention will be set forth in part in the following description, or may be apparent from the description, or may be learned through practice of the invention.

In a first exemplary embodiment, an oven range appliance is provided. The oven range appliance defines a vertical direction, a lateral direction and a transverse direction, the vertical, lateral and transverse directions being mutually perpendicular. The oven range appliance includes a chamber liner defining a cooking chamber, and a cabinet enclosing the chamber liner and cooking chamber. The cabinet extends between a first side and a second side along the lateral direction, between a front and a back along the transverse direction, and between a top and a bottom along the vertical direction. The cabinet includes a side panel positioned at the first side and defining a cooling channel between the chamber liner and the side panel of the cabinet. The oven range appliance additionally includes a diverter panel extending from the side panel toward the chamber liner. The diverter panel blocks a flow of cooling air from the cooling channel at a location proximate the back of the cabinet to increase a flow of cooling air from the cooling channel at a location proximate the front of the cabinet.

In a second exemplary embodiment, an oven range appliance is provided defining a vertical direction, a lateral direction and a transverse direction, the vertical, lateral and transverse directions being mutually perpendicular. The oven range appliance includes a chamber liner defining a cooking chamber, and a cabinet enclosing the chamber liner and cooking chamber. The cabinet extends between a first side and a second side along the lateral direction, between a front and a back along the transverse direction, and between a top and a bottom along the vertical direction. The cabinet includes a side panel positioned at the first side and defines a cooling channel between the chamber liner and the side panel of the cabinet. The oven range appliance additionally includes a diverter panel extending from the side panel toward the chamber liner. The diverter panel is positioned at the top of the cabinet and extends from the front of the cabinet to the back of the cabinet for deflecting cooling air from the cooling channel to a location proximate the front of the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
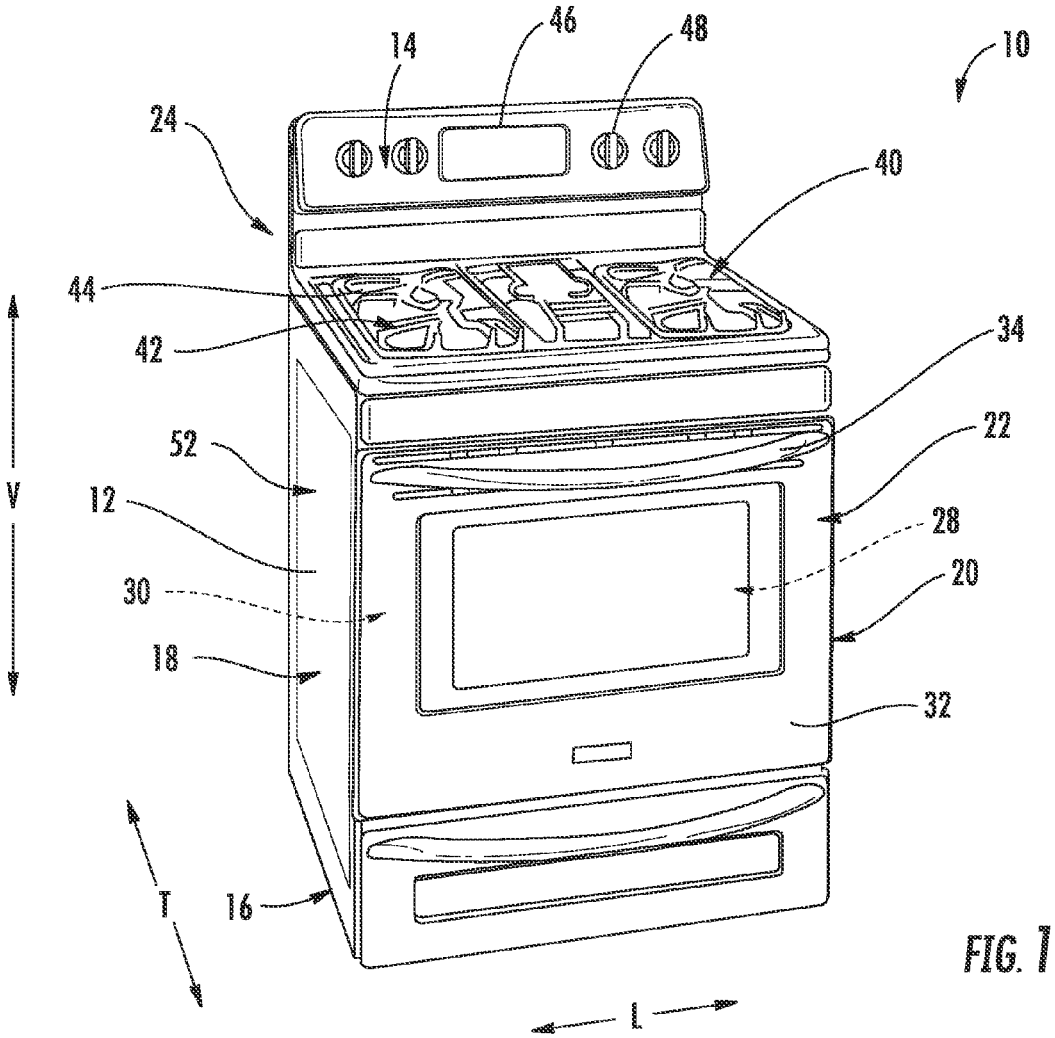
FIG. 1 provides a perspective view of an oven range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
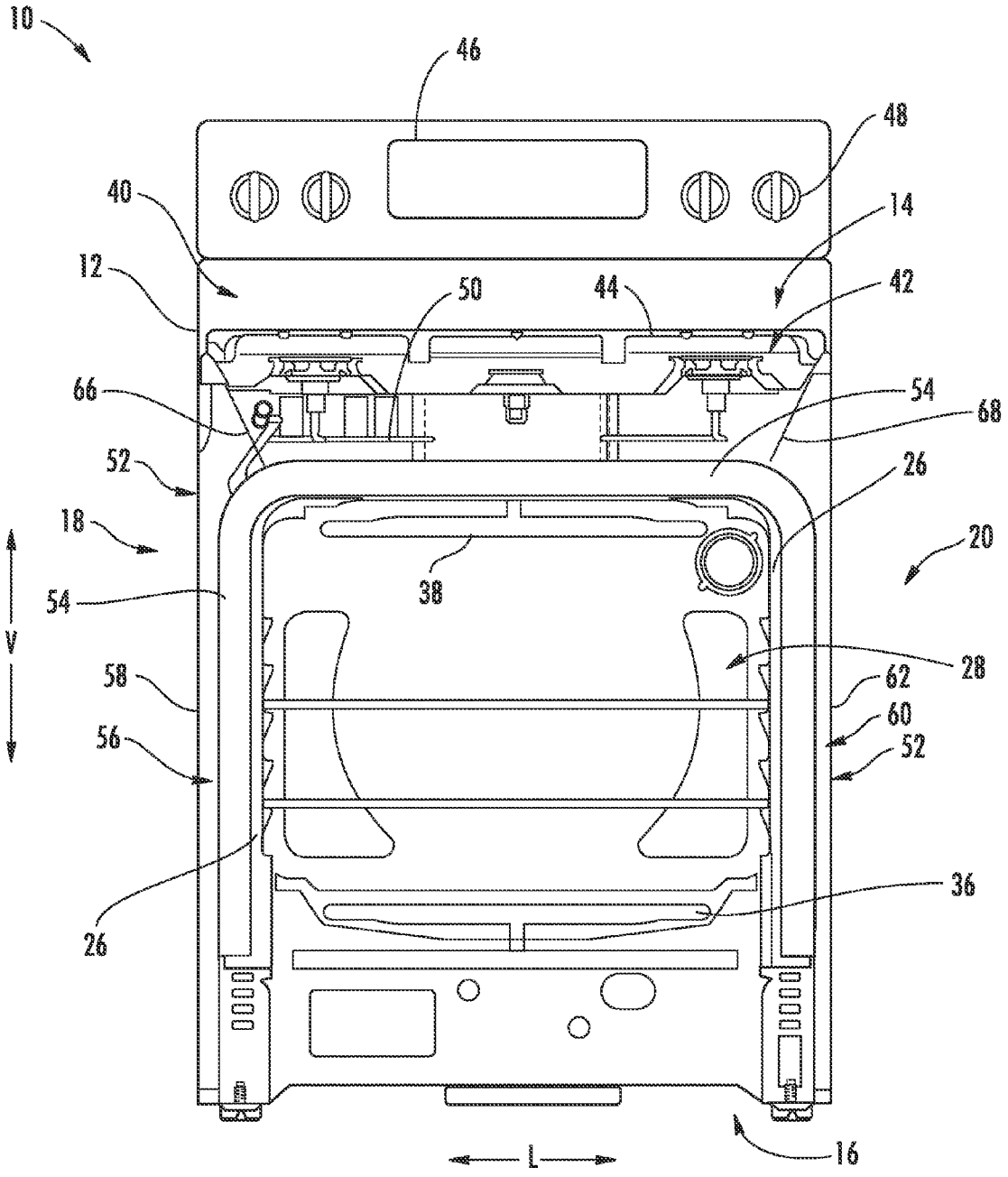
FIG. 2 provides a cross-sectional view of the exemplary oven range appliance of FIG. 1.

Referring now to FIGS. 1 and 2, FIG. 1 provides a front view of an oven range appliance 10 according to an exemplary embodiment of the present subject matter, and FIG. 2 provides a forward-facing-rearward cross-sectional view of the exemplary oven range appliance 10 of FIG. 1. It should be understood that the oven range appliance 10 is provided by way of example only and is not intended to limit the present subject matter in any aspect. Thus, the present subject matter may be used with other oven range appliance configurations, e.g., that define multiple interior cavities for the receipt of food, or other configurations.

As may be seen in FIG. 1, the oven range appliance 10 defines a vertical direction V, a lateral direction L, and a transverse direction T. The vertical, lateral and transverse directions V, L and T are mutually perpendicular and form an orthogonal direction system. The oven range appliance 10 includes a cabinet 12. The cabinet 12 extends between a top 14 and a bottom 16, e.g., along the vertical direction V. The cabinet 12 also extends between a first side 18 and a second side 20, e.g., along the lateral direction L. The cabinet 12 further extends between a front 22 and a back 24, e.g., along the transverse direction T.

The oven range appliance 10 includes a chamber liner 26 defining a cooking chamber 28 (FIG. 2). The chamber liner 26 and cooking chamber 28 are enclosed within the cabinet 12. Additionally, the cabinet 12 defines an opening 30 at the front 22 of cabinet 12 for accessing the cooking chamber 28 and for providing one or more food items to the cooking chamber 28 to be cooked. A door 32 is rotatably mounted to cabinet 12, e.g., with a hinge (FIG. 1). The door 32 is positioned at or adjacent opening 30 of cabinet 12 and is selectively adjustable between an open position (not shown) and a closed position (FIG. 1). With the door 32 in the open position, a user can access the cooking chamber 28 of cabinet 12 through the opening 30 of the cabinet 12. Conversely, the door 32 hinders or prevents access to the cooking chamber 28 of the cabinet 12 through the opening 30 of cabinet 12 when the door 32 is in the closed position. A handle 34 is mounted to the door 32 and assists a user with shifting the door 32 between the open and closed positions in order to access the cooking chamber 28. For example, a user can pull on the handle 34 to adjust the door 32 from the closed position to the open position and access the cooking chamber 28.

Referring particularly to FIG. 2, the exemplary oven range appliance 10 includes a bake or bottom heating element 36 positioned in the cooking chamber 28, e.g., at or adjacent a bottom portion of the cooking chamber 28. The bottom heating element 36 may be used to heat cooking chamber 28 for both cooking and cleaning of oven range appliance 10. The size and heat output of bottom heating element 36 can be selected based on the e.g., the size of oven range appliance 10. The bottom heating element 36 can be any suitable heating element. For example, bottom heating element 36 may be an electric resistance heating element, a gas burner, a microwave heating element, etc. Additionally, the exemplary oven range appliance 10 additionally includes a broil or top heating element 38 positioned in the cooking chamber 28, e.g., at or adjacent top portion of the cooking chamber 28. The top 14 heating element may be used to heat the cooking chamber 28 for both cooking/broiling and cleaning of oven range appliance 10. Like the bottom heating element 36, the size and heat output of the top heating element 38 can be selected based on the e.g., the size of oven range appliance 10. The top heating element 38 can be any suitable heating element. For example, the top heating element 38 may be an electric resistance heating element, a gas burner, a microwave heating element, etc.

The oven range appliance 10 also includes a cooktop portion 40 positioned at the top 14 of the cabinet 12. The cooktop portion 40 includes a plurality of heating assemblies 42 positioned below grates 44. The heating assemblies 42 are positioned above cooking chamber 28 of cabinet 12, e.g., along the vertical direction V. Cooking utensils, such as pots, pans, griddles, etc., may be placed on grates 44 and heated with heating assemblies 42 during operation of the cooktop 40 of the oven range appliance 10. In FIGS. 1 and 2, the heating assemblies 42 are shown as gas burners. However, in alternative exemplary embodiments, the heating assemblies 42 may be any suitable heating assembly 42, such as electric resistance heating elements or induction heating elements.

The operation of oven range appliance 10, including any top and/or bottom heating elements 38, 36 within the cooking chamber 28 and the heating assemblies 42 of the cooktop 40, may be controlled by one or more processing devices (not shown) such as a microprocessor or other device that is in communication with such components. Such processing device (used herein to refer generally to single and/or multiple processing devices) may also be in communication with a control panel 46 having a plurality of user inputs 48. The control panel 46 may provide visual information to a user and allow a user to select various options for the operation of oven range appliance 10 via user inputs 48. One or more of a variety of electrical, mechanical or electromechanical input devices including rotary dials, push buttons, toggle/rocker switches, and/or touch pads can also be used singularly or in combination as user inputs 48. It should be appreciated, however, that in other exemplary embodiments, any other suitable oven range appliance controls may be provided, and that such controls may be positioned in any suitable location.

Figure 3:
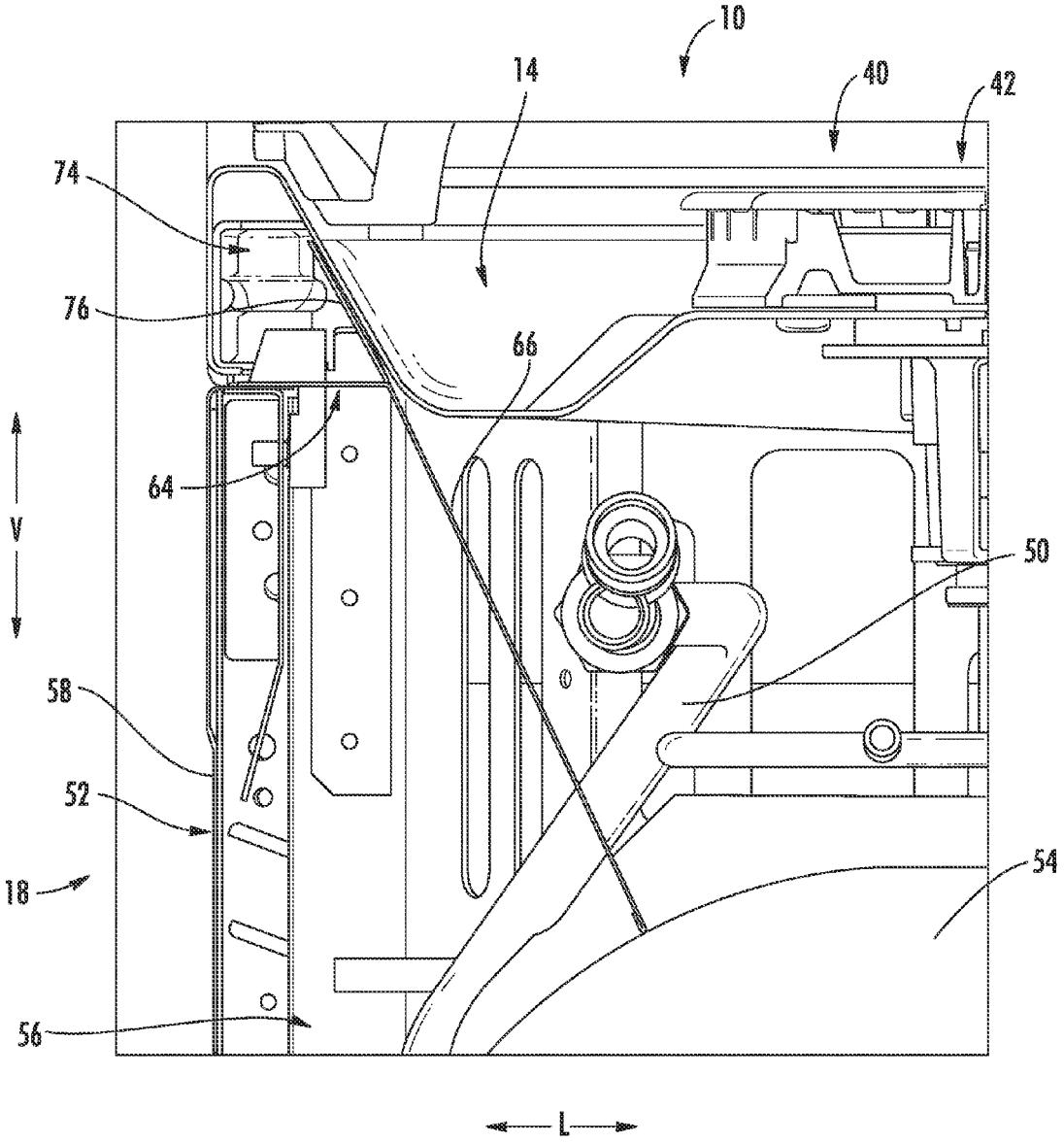
FIG. 3 provides a close up, cross-sectional view of the exemplary oven range appliance of FIG. 1.

Referring now particularly to FIG. 2, as well as to FIG. 3, a close-up view of the top 14 and first side 18 of the cabinet 12 is provided. As previously discussed, the oven range appliance 10 includes the cooktop 40 positioned over the top 14 of the cabinet 12. For the embodiment depicted, the cooktop 40 is a gas range cooktop, including a plurality of heating assemblies 42 configured as gas burners. Accordingly, the exemplary oven range appliance 10 additionally includes a plurality of gas supply lines 50 extending to each of the individual heating assemblies 42 for providing fuel to the respective heating assemblies 42 during operation of the cooktop 40.

Moreover, the oven range appliance 10 includes the chamber liner 26 defining the cooking chamber 28, the chamber liner 26 and cooking chamber 28 enclosed within the cabinet 12 of the oven range appliance 10. In order to maintain a temperature of an outer surface 52 of the cabinet 12 below a desired threshold, the chamber liner 26 is surrounded by a layer of insulation 54 to assist with maintaining heat from the cooking chamber 28 within the cooking chamber 28. The insulation 54 may be any suitable form of insulation, such as a layer of spray foam insulation, fiberglass insulation, foam panel insulation, etc.

To further assist with maintaining a temperature of the outer surface 52 of the cabinet 12 below a desired threshold, the cabinet 12 defines a cooling channel between the chamber liner 26 and a side panel of the cabinet 12. Specifically the cabinet 12 defines a first cooling channel 56 positioned between the chamber liner 26 and a first side panel 58 of the cabinet 12, and a second cooling channel 60 positioned between the chamber liner 26 and a second side panel 62 of the cabinet 12 (FIG. 2). Particularly for the embodiment depicted, the first cooling channel 56 is defined between the first side panel 58 and the layer of insulation 54, and the second cooling channel 60 is similarly defined between the second side panel 62 and the layer of insulation 54. It should be appreciated, however, that in other exemplary embodiments, one or more additional layers of materials not described herein may additionally or alternatively be provided between the first and/or second side panels 58, 62 and the chamber liner 26 to at least partially define the first and/or second cooling channel 56, 60.

In certain exemplary aspects, a cooling airflow may enter the first and/or second cooling channels 56, 60 through an opening (not labeled) positioned proximate the bottom 16 of the cabinet 12. The cooling airflow may absorb heat from the cooking chamber 28 during operation of the cooking chamber 28, as the cooling airflow rises vertically towards the top 14 of the cabinet 12. Undisturbed, the cooling airflow may tend to flow towards a back 24 of the cabinet 12 as it rises vertically.

Figure 4:
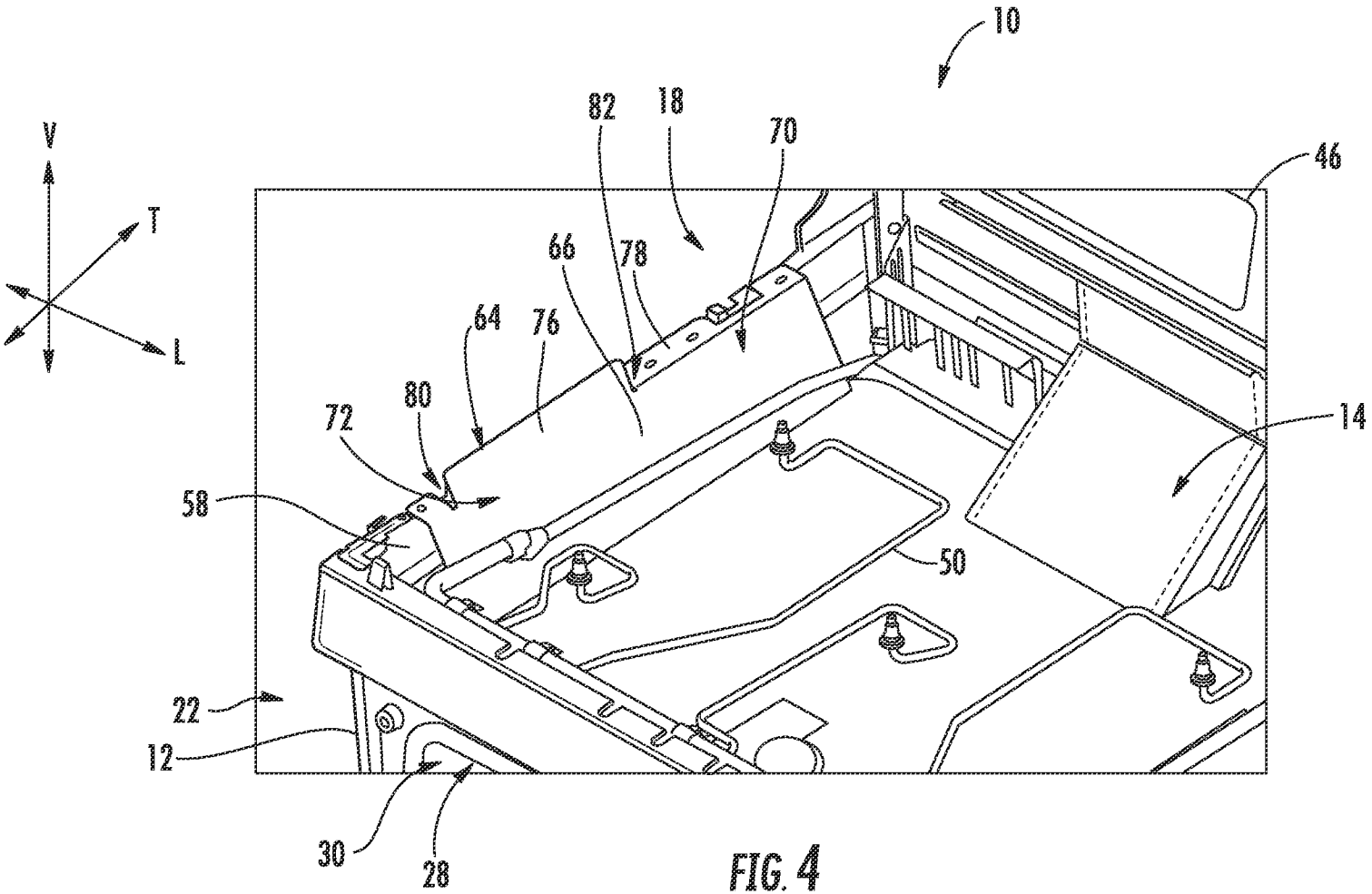
FIG. 4 provides a close-up, perspective view of the exemplary oven range appliance of FIG. 1, having a cooktop removed for clarity.

Referring now also to FIG. 4, the oven range appliance 10 accordingly also includes a first diverter panel 66 extending from the first side panel 58 towards the chamber liner 26 and a second diverter panel 68 extending from the second side panel 62 towards the chamber liner 26. FIG. 4 provides a perspective view of the top 14 of the cabinet 12 and first side 18 of the cabinet 12, with the cooktop 40 removed for clarity. Notably, as discussed above, the oven range appliance 10 includes the layer of insulation 54 surrounding at least a portion of the chamber liner 26 defining the cooking chamber 28. Accordingly, the exemplary first diverter panel 66 extends from the first side panel 58 to the insulation 54 surrounding the chamber liner 26 at a location above the cooking chamber 28. Similarly, the second diverter panel 68 extends from the second side panel 62 also to the insulation 54 surrounding the chamber liner 26 at a location above the cooking chamber 28.

As depicted, the exemplary first diverter panel 66 is positioned at the top 14 of the cabinet 12, and extends from the front 22 of the cabinet 12 to the back 24 of the cabinet 12. Specifically, for the embodiment depicted, the exemplary first diverter panel 66 extends at least about seventy percent across a width of the first side panel 58 along the transverse direction T. However, in other exemplary embodiments, the first diverter panel 66 may instead extend at least about seventy-five percent, at least about eighty percent, at least about ninety percent, or at least about one hundred percent across the width of the first side panel 58 along the transverse direction T. It should be appreciated, that as used herein, terms of approximation such as "substantially" or "about," refer to being within a ten percent margin of error.

Moreover, the first diverter panel 66 is configured to block a flow of cooling air from the first cooling channel 56 at a location proximate the back 24 of the cabinet 12 in order to increase a flow of cooling air from the first cooling channel 56 at a location proximate the front 22 of the cabinet 12. Specifically, as may be seen most clearly in FIG. 4, the first diverter panel 66 includes a blocking portion 70 and a flow portion 72. The blocking portion 70 is formed a generally from a back half of the first diverter panel 66 positioned proximate the back 24 of the cabinet 12, and the flow portion 72 is formed generally of a front half of the diverter panel 66 positioned proximate the front 22 of the cabinet 12. The front half of the diverter panel 66 defines an opening 64 with the first side panel 58 at the location proximate the front 22 of the cabinet 12. The opening 64 extends generally along the transverse direction T, substantially across the front half of the first diverter panel 66. Given the configuration of the cooktop 40, as may be seen in FIG. 3, the opening 64 defined by the first diverter panel 56 and the first side panel 58 opens into a cavity 74 defined with the cooktop 40. The cooling air flowing through the opening 64 defined by the first side panel 58 and the diverter panel 66 may flow rearwardly through the cavity 74 defined with the cooktop 40, providing cooling to such portion of the cooktop 40.

The first diverter panel 66, or more particularly the front half/flow portion 72 of the first diverter panel 66, further includes a heat exchange fin 76 that contacts the cooktop 40 and act as a heat sink for the cooktop 40. For the embodiment depicted, the heat exchange fin 76 extends adjacent to the opening 64 defined by the first diverter panel 66 with the first side panel 58. Particularly for the embodiment depicted, the heat exchange fin 76 extends substantially along a length of the opening 64 (along the transverse direction T) defined by the first diverter panel 66 with the first side panel 58. Accordingly, the heat exchange fin 76 may absorb heat from the cooktop 40 via conduction heat transfer. At least a portion of such heat may then travel through the body of the first diverter panel 66 via convection heat transfer. The heat in the first diverter panel 66 may then be transferred to the cooling air flowing through the opening 64 from the first cooling channel 56. Notably, the first diverter panel 66 may be formed of a metallic material having a relatively high heat transfer coefficient such that, e.g., the heat exchange fin 76 may effectively act as a heat sink for the cooktop 40.

As may also be seen in the Figures, the first diverter panel 66 additionally includes a mounting flange 78 positioned between the cooktop 40 and the first side panel 58 for mounting the first diverter panel 66 to the cabinet 12. For example, one or more screws or bolts may be provided through the mounting flange 78 into the cabinet to mount the first diverter panel 66 to the cabinet. In at least certain exemplary embodiments, the heat exchange fin 76 may be formed of a portion of the mounting flange 78. For example, in at least certain exemplary embodiments, referring particularly to FIG. 4, the first diverter panel 66 may be formed of a sheet of metallic material having a first cut 80 and a parallel second cut 82. The area between the first and second cuts 80, 82 may be considered the heat exchange fin 76. The area outside of the two cuts 80, 82 may then be bent to form the mounting flange 78. Accordingly, the mounting flange 78 may define a width along the lateral direction L that is substantially the same as a length of the heat exchange fin 76.

It should also be appreciated that although not discussed in detail, the second diverter panel 68 may be configured in substantially the same manner as the first diverter panel 66. For example, the second diverter panel 68 may be configured for blocking a flow of cooling air from the second cooling channel 60 at a location proximate the back 24 of the cabinet 12 to increase a flow of cooling air from and through the second cooling channel 60 a location proximate a front 22 of the cabinet 12.

Figure 5:
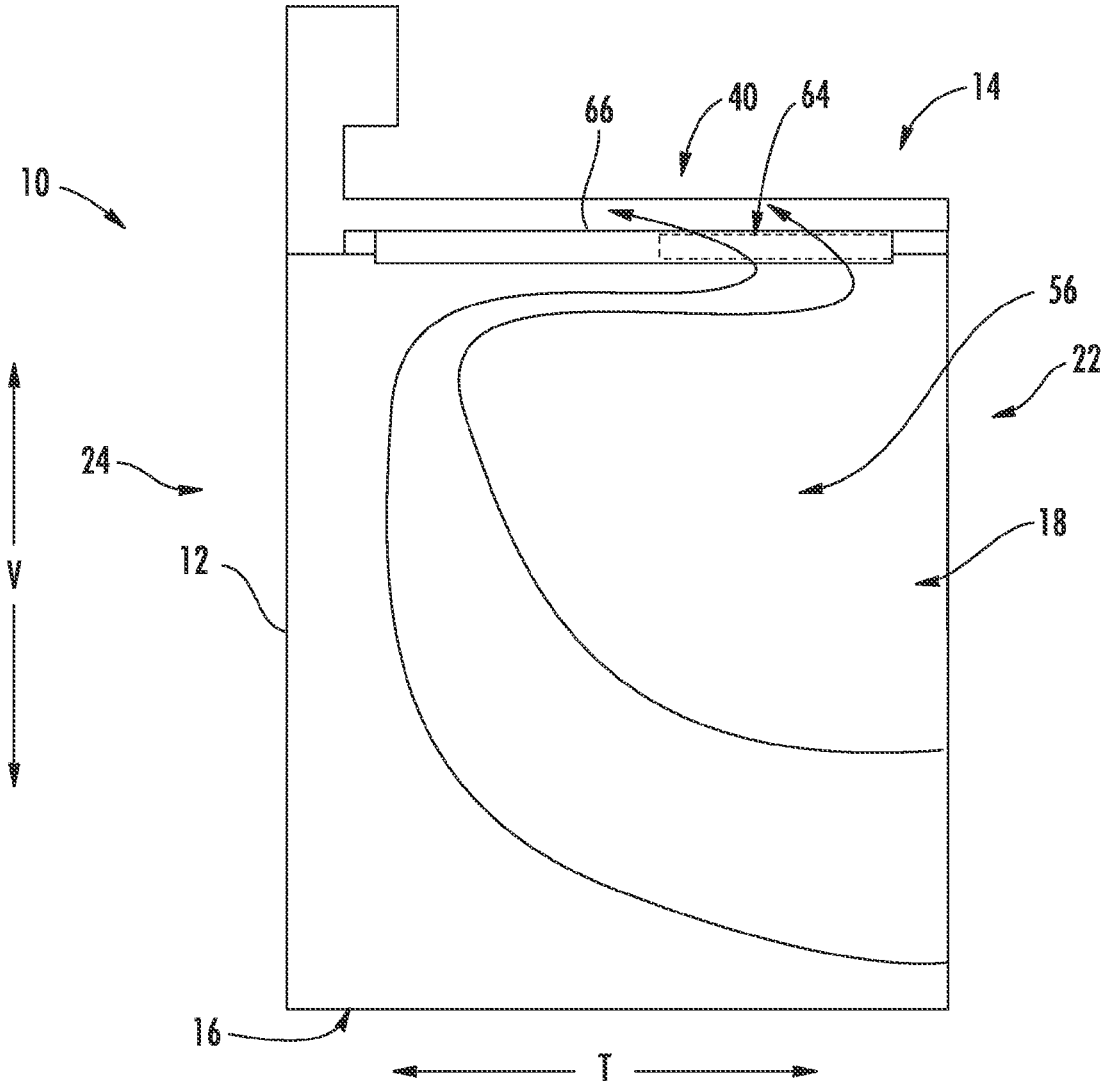
FIG. 5 provides a side, schematic view of an oven range appliance in accordance with an exemplary embodiment of the present disclosure.

Referring now to FIG. 5, a side, schematic view is provided of an oven range appliance 10 including a diverter panel 66 in accordance with an exemplary embodiment of the present disclosure. As shown, cooling air enters a cooling channel 56 from a location proximate a bottom 16 of the cabinet 12 and proximate a front 22 of the cabinet 12. The cooling airflow flows rearwardly and vertically upwardly through the cooling channel 56. The natural flow of such cooling air is diverted by the diverter panel 66 positioned at the top 14 of the cabinet 12 and extending from the front 22 of the cabinet 12 to the back 24 of the cabinet 12. Specifically, the diverter panel defines an opening 64 proximate the front 22 of the cabinet 12 such that the diverter panel 66 blocks a flow cooling air through the cooling channel 56 at a location proximate the back 24 of the cabinet 12 and increases a flow of cooling air from the cooling channel 56 at a location proximate the front 22 of the cabinet 12.

An oven range appliance including a diverter panel in accordance with an exemplary embodiment of the present disclosure may promote a more even cooling of a cabinet of the oven range appliance, or more particularly, of a side panel of the cabinet of the oven range appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven range appliance defining a vertical direction, a lateral direction and a transverse direction, the vertical, lateral and transverse directions being mutually perpendicular, the oven range appliance comprising:

a chamber liner defining a cooking chamber;

a cabinet enclosing the chamber liner and cooking chamber, the cabinet extending between a first side and a second side along the lateral direction, between a front and a back along the transverse direction, and between a top and a bottom along the vertical direction, the cabinet including a side panel positioned at the first side and defining a cooling channel between the chamber liner and the side panel of the cabinet; and a diverter panel extending from the side panel toward the chamber liner, the diverter panel blocking a flow of cooling air from the cooling channel at a location proximate the back of the cabinet to increase a flow of cooling air from the cooling channel at a location proximate the front of the cabinet; wherein the diverter panel extends from the front of the cabinet to the back of the cabinet and defines an opening with the side panel at the location proximate the front of the cabinet.

2. The oven range appliance of claim 1, wherein the diverter panel positioned at the top of the cabinet.

3. The oven range appliance of claim 1, further comprising a cooktop positioned over the top of the cabinet, wherein the opening defined by the diverter panel and the side panel opens into a cavity defined with the cooktop.

4. The oven range appliance of claim 1, further comprising insulation surrounding at least a portion of the chamber liner, wherein the diverter panel extends between the side panel and the insulation.

5. The oven range appliance of claim 1, further comprising a cooktop positioned over the top of the cabinet, wherein the diverter panel includes a heat exchange fin that contacts the cooktop and acts as a heat sink for the cooktop.

6. The oven range appliance of claim 5, wherein the diverter panel defines an opening with the side panel at the location proximate the front of the cabinet, wherein the heat exchange fin extends adjacent to the opening.

7. The oven range appliance of claim 5, wherein the diverter panel includes a mounting flange positioned between the cooktop and the side panel.

8. The oven range appliance of claim 1, wherein the diverter panel is formed of a metallic material.

9. The oven range appliance of claim 1, further comprising insulation surrounding at least a portion of the chamber liner, wherein the cooling channel is defined between the side panel and the insulation surrounding at least a portion of the chamber liner.

10. An oven range appliance defining a vertical direction, a lateral direction and a transverse direction, the vertical, lateral and transverse directions being mutually perpendicular, the oven range appliance comprising:

a chamber liner defining a cooking chamber;

a cabinet enclosing the chamber liner and cooking chamber, the cabinet extending between a first side and a second side along the lateral direction, between a front and a back along the transverse direction, and between a top and a bottom along the vertical direction, the cabinet including a side panel positioned at the first side and defining a cooling channel between the chamber liner and the side panel of the cabinet; and a diverter panel extending from the side panel toward the chamber liner, the diverter panel positioned at the top of the cabinet and extending from the front of the cabinet to the back of the cabinet for deflecting cooling air from the cooling channel to a location proximate the front of the cabinet; wherein the diverter panel extends from the front of the cabinet to the back of the cabinet and defines an opening with the side panel at the location proximate the front of the cabinet.

11. The oven range appliance of claim 10, further comprising a cooktop positioned over the top of the cabinet, wherein the opening defined by the diverter panel and the side panel opens into a cavity defined with the cooktop.

12. The oven range appliance of claim 10, further comprising insulation surrounding at least a portion of the chamber liner, wherein the diverter panel extends between the side panel and the insulation.

13. The oven range appliance of claim 10, further comprising a cooktop positioned over the top of the cabinet, wherein the diverter panel includes a heat exchange fin that contacts the cooktop and acts as a heat sink for the cooktop.

14. The oven range appliance of claim 13, wherein the diverter panel defines an opening with the side panel at the location proximate the front of the cabinet, wherein the heat exchange fin extends adjacent to the opening.

15. The oven range appliance of claim 13, wherein the diverter panel includes a mounting flange positioned between the cooktop and the side panel.

16. The oven range appliance of claim 10, wherein the diverter panel is formed of a metallic material.

17. The oven range appliance of claim 10, further comprising insulation surrounding at least a portion of the chamber liner, wherein the cooling channel is defined between the side panel and the insulation surrounding at least a portion of the chambers liner.

* * * * *